US005626125A

United States Patent [19]

Eaves

[11] Patent Number: 5,626,125

[45] Date of Patent: May 6, 1997

[54] SPACE HEATING APPLIANCES

[75] Inventor: Robert N. Eaves, Lutley, Great Britain

[73] Assignee: AMBI-RAD Limited, Halesowen, United Kingdom

[21] Appl. No.: 512,115

[22] Filed: Aug. 7, 1995

[30] Foreign Application Priority Data

Aug. 10, 1994 [GB] United Kingdom ..... 9416130

[51] Int. Cl.[6] ..... F24C 3/04

[52] U.S. Cl. ..... 126/91 A; 126/92 B

[58] Field of Search ..... 126/92 B, 91 R, 126/91 A; 392/423; 237/70, 33, 3

[56] References Cited

U.S. PATENT DOCUMENTS

| | | | |
|---|---|---|---|
| 2,946,510 | 7/1960 | Galvin | 126/91 A X |
| 3,502,844 | 3/1970 | Lawes et al. | 392/424 X |
| 4,208,573 | 6/1980 | Risse | 392/422 X |
| 4,563,572 | 1/1986 | Hager, Jr. | 392/423 |
| 4,727,854 | 3/1988 | Johnson | 126/91 A X |

FOREIGN PATENT DOCUMENTS

| | | | |
|---|---|---|---|
| 0249087 | 12/1987 | European Pat. Off. | 237/70 |
| 0261639 | 3/1988 | European Pat. Off. . | |
| 1119194 | 6/1956 | France | 392/423 |
| 3903540 | 8/1990 | Germany | 126/92 B |
| 0118329 | 5/1990 | Japan | 392/423 |
| 402287023 | 11/1990 | Japan | 392/423 |
| 1448073 | 9/1976 | United Kingdom . | |
| 2108260 | 11/1983 | United Kingdom . | |
| 2119075 | 11/1983 | United Kingdom . | |

*Primary Examiner*—Carl D. Price
*Attorney, Agent, or Firm*—Learman & McCulloch

[57] ABSTRACT

A space heating appliance includes a radiant duct which, when heated, emits radiant heat for heating an area adjacent the duct. An insulated cowling shrouds the side of the duct away from the area to be heated in spaced relation to the duct. The cowling has a heat-emissive surface which when heated emits radiant heat toward the space to be heated. Between the duct and cowling in closely spaced proximity to the duct is an insulated heat shield which traps and redirects heat back to the duct in order to maintain the duct at a higher temperature and concentrate the emission of heat in the direction of the area to be heated.

13 Claims, 2 Drawing Sheets

SPACE HEATING APPLIANCES

This invention relates to radiant tube space heating appliances of the kind comprising a radiation tube or duct, commonly suspended overhead in the space to be heated, a fan or other pump for inducing flow of gases along the duct in use, and one or more fluid fuelled burner assemblies, typically gas fired and automatically controlled, for feeding hot gases into said flow. Said appliances are hereinafter referred to as "radiant tube heating appliances".

BACKGROUND OF THE INVENTION

In order to direct and concentrate the radiant heat emitted from the duct surface it is known to provide reflectors, typically of sheet metal, mounted adjacent to the duct, e.g. above it if the appliance is mounted overhead to direct the heat downwards.

It is also known to provide bodies of thermal insulating material shielding the duct on the side remote from the space to be heated, examples of such constructions being described in GB-A-2119075, GB-A-2108260, GB-A-1448073, EP-A-0261639 and US-A-4727854.

The object of the invention is to provide improvements in radiant tube heating appliances giving greater efficiency.

According to the invention there is provided a radiant tube heating appliance as defined in claim 1 of the appended claims.

SUMMARY OF THE INVENTION

In the case of a circular section duct said shield formation may encompass from approximately a 180 degree (i.e. said half circumference) down to approximately a 90 degree angular zone of the periphery, and typically about a 140 degree angular zone.

Said formation may be formed of ceramic fibre material, preferably with little or no organic binder with or without facing and/or backing of sheet metal or the like.

A single formation may extend the full length of the duct or of a straight run or leg thereof, or a series of said formations may be provided along its length either adjoining or spaced at intervals, or the shield formation or formations may be applied to a selected longitudinal zone or zones of the duct only.

It or they may be spaced from about 6 mm up to about 25 mm from the duct outer surface.

Preferably the front face of said sheet material of the cowling has a black or other dark coloured highly radiant heat emissive surface or surface finish.

One or more shield formations as defined above may be used in combination with said cowling, i.e. it or they will be mounted in close proximity to the duct periphery within a common cowling and in spaced relationship therewith.

The insulating material used for the cowling may also be the ceramic fibre material referred to above or mineral wool.

THE DRAWING

An example of the invention is now more particularly described with reference to the accompanying drawings wherein:

FIG. 1 is a diagrammatic perspective view with some parts broken away of a radiant tube space heating appliance, and FIG. 2 is a vertical cross-section of said appliance.

DETAILED DESCRIPTION

Figure 1:
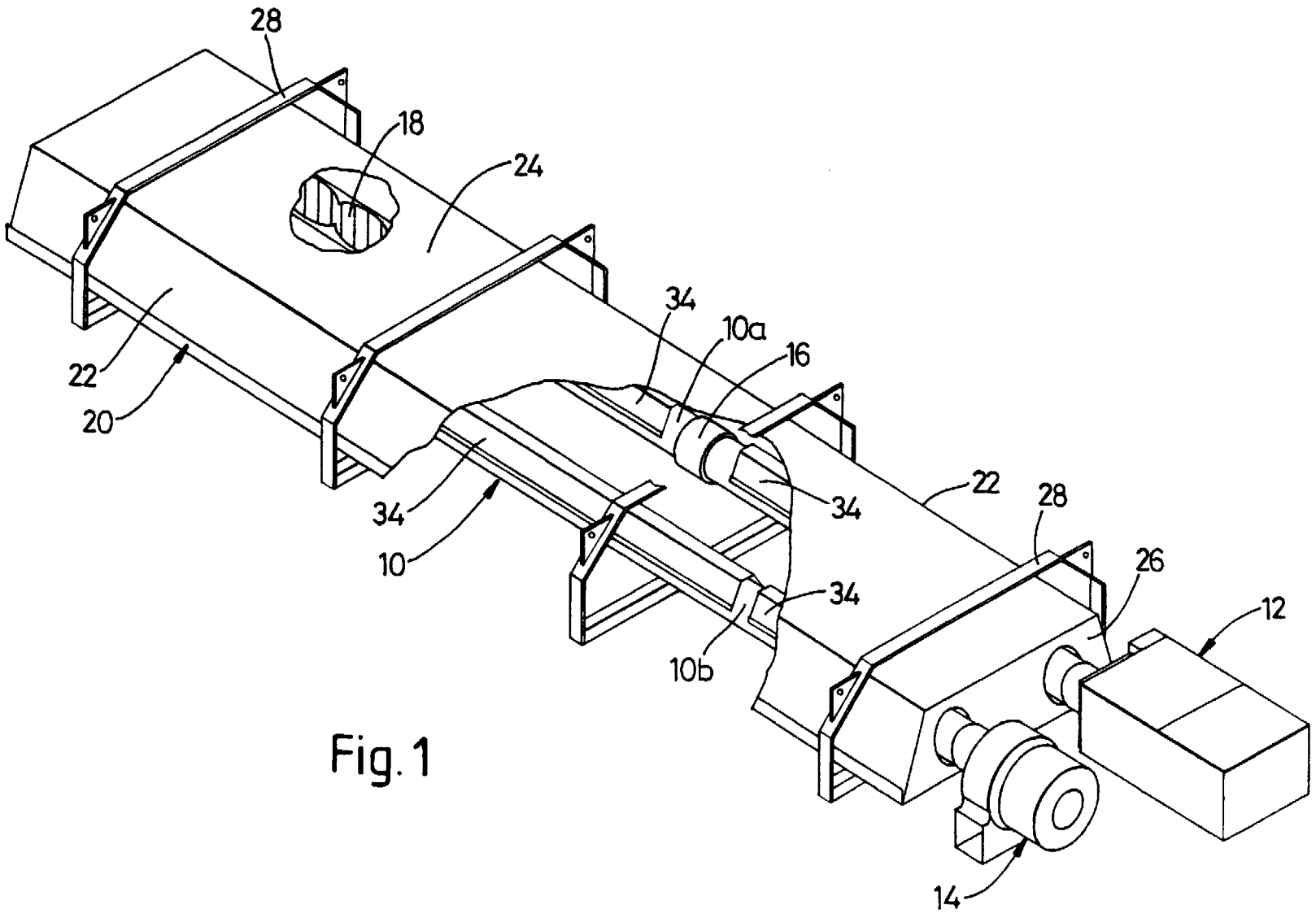
Figure 2:
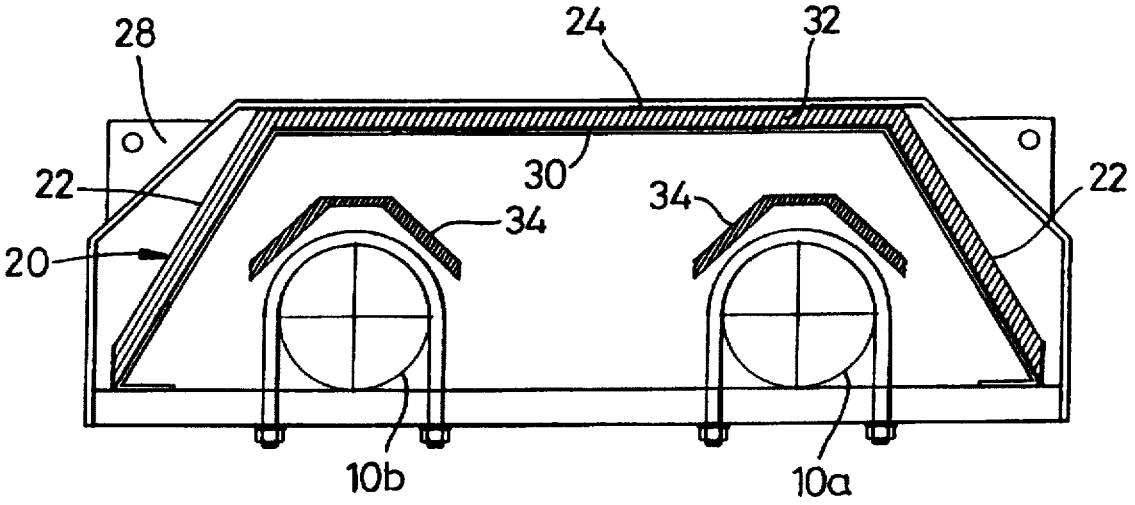

The radiant tube space heating appliance of this example is for suspended installation overhead for heating a space such as part of a factory building or public hall. The heat generating parts of the appliance are generally of conventional type comprising a run of circular section radiation tube 10 through which hot gases provided by a burner assembly 12 at an input end of the run are drawn by an exhaust fan 14 at the output end of the run. Automatic ignition, running and safety controls are incorporated in known manner.

In this example tube 10 is U shaped in plan so that it has spaced parallel upstream and downstream legs 10*a*, 10*b*. This arrangement is convenient in that a compact unit is provided which can readily be positioned where required, and in that the burner assembly 12 and fan 14 are brought alongside each other, so simplifying control, assembly and maintenance.

For heating large areas several such appliances may be used.

In use a mix of gas fuel and air is provided at burner assembly 12 for combustion, burning taking place as a flame directed downstream from said input end of tube 10. Thus the portion of tube adjacent that end will be hottest, typically temperatures of the order of from 250° to 800° C. will be attained in immediate proximity to that part of the tube. To prevent distortion in this upstream leg 10*a* of the-tube an expansion coupling 16 is provided. The flow of hot gases heats the whole tube 10 so that radiant heat is emitted from its outer periphery.

For some applications a twisted sheet metal or other turbulator 18 may be provided within tube 10 or a part or parts thereof acting on the flow of gases in known manner to improve heat transfer to the tube walls.

A known appliance of this type would normally be provided with a sheet metal reflector in the form of a downwardly open hood positioned above and extending to the sides of the pair of parallel tube legs 10*a*, 10*b* and having a more or less polished, bright or light coloured surface finish intended to reflect radiant heat emitted upwards from tube 10 back down again for the most effective heating of the area below the appliance in use. Such reflectors have limited efficiency in concentrating heat output downwards for they themselves become heated by conduction from said surface and some of that heat is in turn emitted from the top or back of the reflector where it is largely wasted.

Furthermore, unless regular maintenance is carried out to clean the under-surface of the reflector which is particularly prone to accumulate dust and dirt, especially in industrial buildings, the reflective properties will be largely lost as the reflector surface becomes darker and dirty. This also gives an unsightly appearance to the appliances which may not be acceptable in buildings such as public halls. Access to the overhead heating appliances for maintenance is usually difficult and inconvenient e.g. it may only be possible when premises are out of use during a holiday period or outside normal hours in which case labour charges will be greater. Thus any saving in the need for maintenance is a substantial benefit.

In the case of the heating appliance now described the place of the normal reflector is taken by a heat projection cowling 20. The bottom of this cowling is open, its lower edges being approximately on a common level with the lowermost periphery of tube 10. It has upwardly convergent side walls 22 and a flat horizontal top wall 24, all these walls being spaced away from tube 10 to give a clearance, in this example, of approximately half to three quarters of the tube diameter.

Cowling 20 extends the full length of tube 10 and is provided with vertical end walls, one of which 26 is apertured to receive the extremities of the tube where it connects with burner assembly 12 and fan 14. These end walls may be omitted in some constructions.

Cowling 20 is supported within hanger frames 28 which also support and locate the two tube legs 10*a*, 10*b*. These frames are, in turn, attached to chains or other hangers (not shown) for supporting the appliance horizontally at the appropriate overhead height.

The inner or under face of cowling 20 which is directed towards tube 10 and towards the area to be heated is a sheet metal facing sheet 30, for example mild steel sheet which has been pre-coated with a high temperature resistant finish such as a silicone polyester compound and this is preferably black in colour or some other dark colour for maximising emission of radiant heat therefrom. An aluminium coated or aluminised steel of black or dark colouring could also be used.

Cowling 20 further consists of a layer 32 of thermally insulating material backing sheet 30, for example a 25 mm thickness of ceramic fibre or mineral wool insulation material having little or no organic binder. Layer 32 substantially reduces emission or other loss of heat from the top or back of cowling 20. Sheet 30 will thus attain a higher temperature and, due to its black or dark finish, will itself act as an emitter of radiant heat back towards tube 10 and towards the area where heat is wanted.

An incidental advantage is that less heat will pass upwards from the appliance reducing damage and discoloration of ceilings or other roof areas and also providing improved fire safety and/or enabling the appliance to be mounted closer to the ceiling or roof than would otherwise be the case. Thus the use of the invention may enable this type of heater to be employed in rooms or spaces where limited headroom would prevent use of overhead heaters of conventional type.

Cowling 20 also helps to distribute the emitted heat evenly over a greater area. Its dark colouring makes discoloration by dirt and dust less noticeable and as performance will not be substantially affected thereby, need for maintenance and cleaning is substantially reduced.

To further add to efficiency and the concentration of heat output towards and in the desired area each leg 10*a*, 10*b* of the tube is provided with individual shield formations 34. These are wholly or mainly formed from thermally insulating material, for example ceramic fibre with little or no organic binder. They are typically approximately 6 mm in wall thickness and are spaced in close proximity above the top half circumference of the respective tube leg, typically spaced around 6 to 25 mm therefrom. The insulating material may have a sheet metal facing or backing for greater durability.

Sides of shield formations 34 are angled downwards so that each formation encompasses an angular zone of the tube upper periphery which is about 140 degrees in extent in this example. For some applications the shield formations may encompass up to the half circumference i.e. 180 degrees or maybe somewhat less, e.g. down to 90 degrees.

In this example a series of shield formations 34 are disposed in end-to-end relationship along each leg 10*a*, 10*b* but, depending on the size of heating appliance, a single shield formation might occupy the whole length of such a leg, or for some applications shield formations may be provided only in localised parts of the tube length. The spacing from the tube means that formations 34 are not subjected to the full heat of the tube, particularly at the high temperature input end, as they would be if they were in direct contact therewith so that they became heated by conduction.

As with the cowling 20 the shield formations 34 trap emitted heat radiated from tube 10 in the upward direction so keeping the tube at a higher temperature and concentrating emission in the downward direction.

It is to be understood that cowling 20 could be used in a radiant heating appliance without there being any shield formations 34 or, conversely, one or more of the latter formations might be used without cowling 30 e.g. with or without a conventional sheet metal or other reflector.

Using both together brings maximum advantages in terms of efficiency, preliminary tests applying the latest draft European measurement standard DD ENV12591:1994 in combination with a good quality burner, fan and tube assembly showed an increase in radiant efficiency from 63% net to as much as 79% net.

It is also to be understood that the invention may be applied to radiant tube space heating appliances of pattern d above. For example the cowling and/or shield formations can equally be used in combination with larger installations having multiple burners serving a common run or runs of branched or other radiant emission ducting for buildings or the like having a large floor area.

I claim:

1. A radiant tube space heating appliance, comprising:

a radiant duct capable of emitting radiant heat in response to being heated by hot gases directed through said duct for heating an area adjacent said duct;

at least one shield member fabricated of thermally insulating material supported in closely spaced relation to said duct adjacent a side thereof opposite the area to be heated, said shield member partially surrounding said duct but extending no further than about half of the circumference of the duct for insulating the space between said shield member and said duct against heat loss and redirecting any heat emitted into said space back toward said tube; and a heat projection cowling member supported in spaced relation to each of said duct and said shield member, said cowling extending beyond said shield member and terminating at an end open to the area to be heated and lying in a plane generally common with a peripheral part of the duct furthest from said shield member such that said cowling substantially encloses said shield member and said duct, said cowling having an inner wall formed of rigid sheet material and an outer backing layer formed of thermally insulating material.

2. The appliance of claim 1 wherein said duct has a circular cross-sectional shape and said shield member encompasses an arc of said duct of between about 90 and 180 degrees.

3. The appliance of claim 2 wherein said shield member encompasses an arc of about 140 degrees.

4. The appliance of claim 1 wherein said shield member is spaced from about 6 mm to 25 mm from said duct.

5. The appliance of claim 1 wherein said shield member is fabricated from fibrous ceramic material.

6. The appliance of claim 5 wherein said fibrous ceramic material is substantially free of organic binder.

7. The appliance of claim 5 wherein said shield member includes a facing layer of sheet metal applied to said fibrous ceramic material.

8. The appliance of claim 1 wherein said insulating material of said cowling is selected from a group consisting essentially of fibrous ceramic and mineral wool substantially free of organic binder.

9. The appliance of claim 1 wherein said sheet material of said cowling comprises metal having a dark-colored, highly radiant heat-emissive surface finish for emitting radiant heat back toward said duct and the space to be heated.

10. The appliance of claim 9 wherein said metal comprises mild steel and said surface finish is selected from a group consisting essentially of silicon polyester compound, aluminum coating, and aluminized coating.

11. The appliance of claim 1 wherein said duct includes at least two adjacent runs and a corresponding said shield member for each run and wherein said runs and their said shield members are encompassed by said cowling.

12. The appliance of claim 11 wherein said duct is U-shaped providing two parallel said runs and associated said shield members.

13. A radiant tube heating appliance, comprising:

a radiant heat-emitting duct for heating an area adjacent said duct;

a radiant heat-emissive cowling supported in spaced relation to said duct opposite the area to be heated, said cowling having a dark-colored, highly radiant heat-emissive surface open to the space to be heated and responsive to being heated by the heat of said duct to emit radiant heat back toward the area to be heated, said cowling having a thermally insulating layer backing said heat-emissive surface to limit the transfer of heat through said cowling; and at least one insulating heat shield supported between said a duct and said cowling in spaced relation to said heat-emissive surface and in closely-spaced proximity to said duct to insulate a zone between said duct and said heat shield against heat loss and redirect heat entering said zone back toward said duct to limit heat loss of said duct in the direction away from the area to be heated.

* * * * *

UNITED STATES PATENT AND TRADEMARK OFFICE

CERTIFICATE OF CORRECTION

PATENT NO. : 5,626,125
DATED : May 6, 1997
INVENTOR(S) : Robert N. Evans

It is certified that error appears in the above-indentified patent and that said Letters Patent is hereby corrected as shown below:

Column 1, delete lines 26-28.

Column 4, bridging lines 24 and 25, change "pattern d above" to -- types other than the self-contained burner U tube pattern described above. --

Signed and Sealed this

Twenty-second Day of July, 1997

Bruce Lehman

*Attest:*

BRUCE LEHMAN

*Attesting Officer*

*Commissioner of Patents and Trademarks*